US005261187A

United States Patent [19]

Prenger

[11] Patent Number: 5,261,187

[45] Date of Patent: Nov. 16, 1993

[54] APPARATUS FOR GATE CONTROL

[75] Inventor: Edmund J. Prenger, Houston, Tex.

[73] Assignee: Rescor (Renewable Energy Systems Corporation), Houston, Tex.

[21] Appl. No.: 950,711

[22] Filed: Sep. 25, 1992

[51] Int. Cl.[5] ..... E05F 11/54

[52] U.S. Cl. ..... 49/362

[58] Field of Search ..... 49/362, 360

[56] References Cited

U.S. PATENT DOCUMENTS

| | | | |
|---|---|---|---|
| 612,565 | 10/1898 | Kaiser | 49/362 X |
| 1,862,932 | 6/1932 | Home | 49/362 |
| 3,691,684 | 9/1972 | Boneck | 49/362 X |
| 4,366,649 | 1/1983 | Weigant | 49/362 |
| 4,858,383 | 8/1989 | Kendig | 49/362 X |

*Primary Examiner*—Philip C. Kannan

*Attorney, Agent, or Firm*—Dougherty, Hessin, Beavers & Gilbert

[57] ABSTRACT

A sliding gate control device consisting of an elongated rack member that is resiliently mounted across the lower extremities of a sliding gate that is movable by guide structure, and a control unit mounted adjacent to the guideway actuatable to provide a pinion gear drive for engagement with said rack member thereby to slidably move the gate laterally across the right of way. Adjustable tension assemblies provide the resilient rack mounting that assures a continual positive rack/pinion engagement for reliable operation.

5 Claims, 2 Drawing Sheets

APPARATUS FOR GATE CONTROL

BACKGROUND OF THE INVENTION

1. Field of the Invention

The invention relates generally to gate control devices responsive to check enablement and, more particularly, but not by way of limitation, it relates to an improved type of gate control device for use with longitudinally sliding types of gates.

2. Description of the Prior Art

The prior art includes numerous types of gate actuators for use with swinging gates, lift gates and lay-down gates as well as more hybrid types of security closures. One type of gate utilized in automatic security protection is the so-called sliding gate that can be automatically operated open and closed by longitudinal sliding movement. Heretofore, this type of gate has been operated by means of a chain drive connection wherein a drive actuation provides a controllable chain drive output. It is this particular type of chain drive system that the present invention replaces as it provides an improved operation.

SUMMARY OF THE INVENTION

The present invention relates to improvements in automatic gate control systems of the type used to control elongated, horizontally slidable gates. An elongated gate of selected length, depending upon the exigencies of the security task, includes a plurality of bottom wheels which ride upon a track during opening and closing movement. The track is secured transverse to the security right-of-way. A rack bar is resiliently mounted horizontally across the lower extremities of the gate while a control drive section is mounted adjacent the gate to extend a rotational pinion gear into engagement with the rack bar. The rack bar can then be level adjusted through its resilient mountings to properly engage the pinion gear throughout its traverse despite variations in track level. The drive unit is controlled by a suitable entry check to actuate the pinion gear between pre-set limits thereby to effect opening and closing of the sliding gate.

Therefore, it is an object of the present invention to provide a gate control device that is more reliable in operation than existing chain drive installations.

It is also an object of the present invention to provide a rack and pinion drive for sliding gate that is readily adjustable to account for track level and other installation alignment problems.

Finally, it is an object of the present invention to provide a rack and pinion gate drive for sliding gate that is more easily maintained and more reliable in operation.

Other objects and advantages of the invention will be evident from the following detailed description when read in conjunction with the accompanying drawings which illustrate the invention.

DETAILED DESCRIPTION OF THE INVENTION

Figure 1:
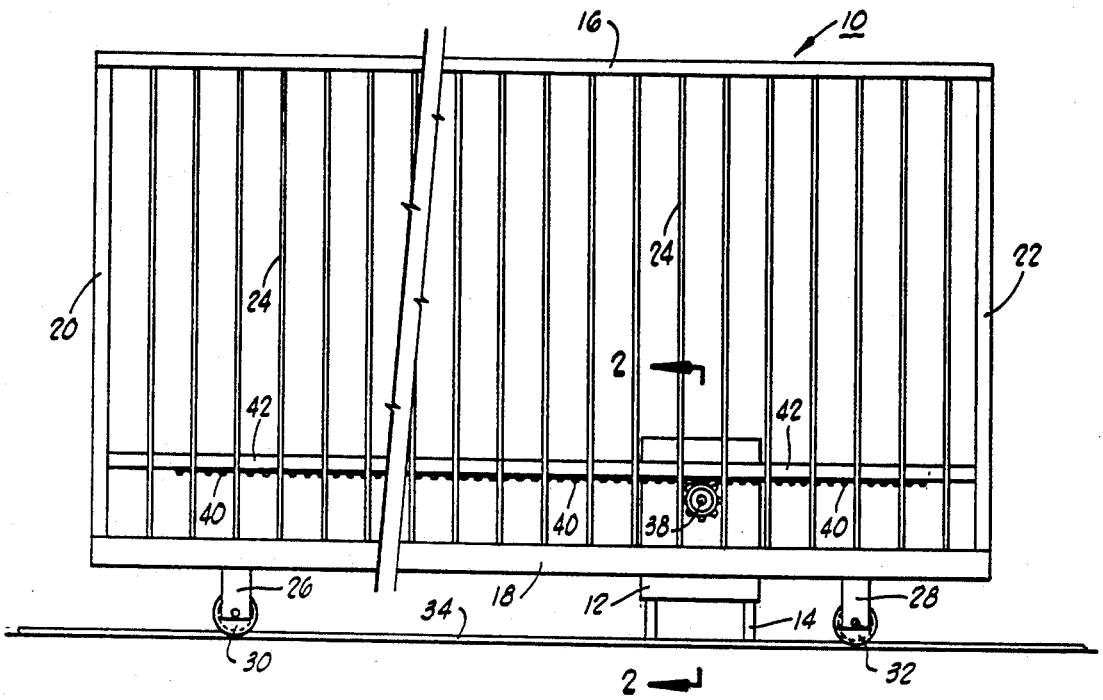
FIG. 1 is a front view in elevation of the invention.

Referring to FIG. 1, a gate 10 is positioned for automatic control by means of a control unit 12 that is suitably supported by such as mounts 14 adjacent the operational path of gate 10. The gate 10 could be any of many types of gate device suitable for sliding gate usage and, for the sake of illustration, gate 10 consists of a metal gate having horizontal upper and lower bars 16 and 18, vertical end bars 20 and 22 and a suitable plurality of vertical bars 24 across the expanse of the gate.

The gate 10 may be constructed to be as wide as required for the particular security closure, i.e., either for a walkway or for a wider driveway area. The plurality of wheel brackets 26, 28 are secured as by welding to the underside of lower bar 18 to carry respective wheels 30 and 32 rotationally therein. The wheels 30 and 32 are grooved (see FIG. 2) for the purpose of engaging a guide rail 34 that is secured across the right of way thereby defining the path of movement.

Figure 2:
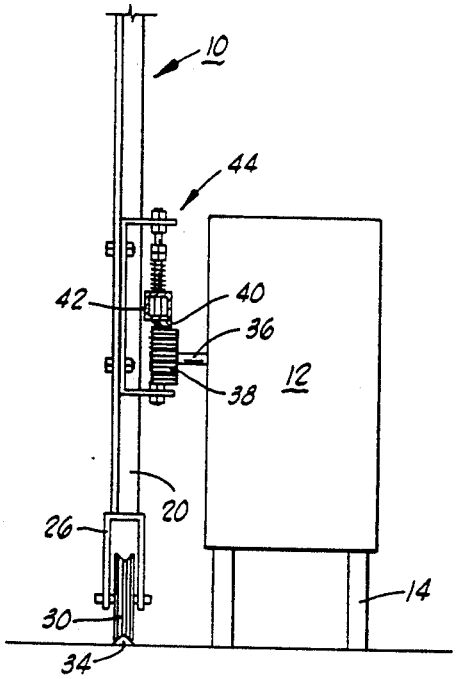
FIG. 2 is a side view taken along lines 2—2 of FIG. 1.
Figure 3:
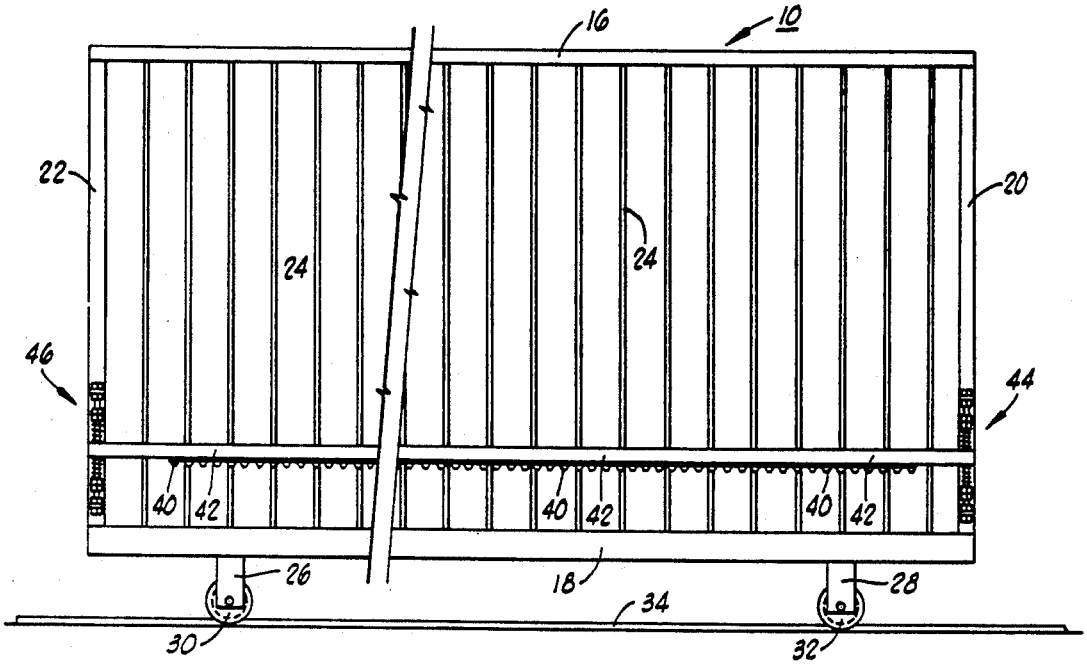
FIG. 3 is a rear view in elevation of the sliding gate with adjustable rack bar.

Referring also to FIGS. 2 and 3, the control unit 12 is operable to provide rotary output on a shaft 36 to a pinion gear 38. The pinion gear 38 is in engagement with a rack bar 40 which is welded along the underside of a square tube 42 that extends the length of gate 10 and is resiliently supported by tension assemblies 44 and 46 as secured on opposite end bars 20 and 22. The square tube 42 is mounted to extend generally horizontally across the bottom of gate 10 and parallel to the guide rail 34, and fine adjustments may be made to the tension assemblies 44 and 46 to assure proper meshing of the pinion 38 with rack bar 40 across the expanse, as will be further described.

Figure 4:
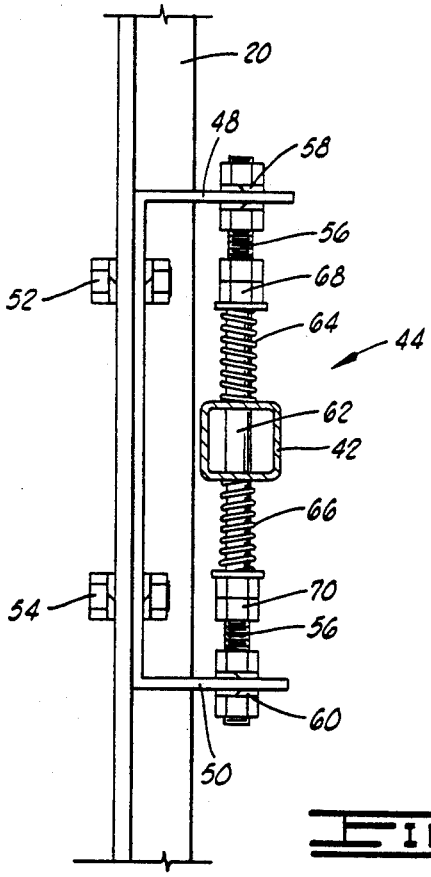
FIG. 4 a side view of a portion of the gate of FIG. 3 showing the adjustment mounting assembly.

Referring to FIG. 4, each of the tension assemblies is similar, and tension assembly 44 is mounted by means of a brace extending first and second angle brackets 48 and 50 which are tightly secured to the end bar 20 by means of bolts 52 and 54. A threaded bar 56 is then positioned down through angle brackets 48 and 50 and secured top and bottom by means of respective washer/nuts 58 and 60. The opposite ends of tube 42 are fitted with a sleeve bushing 62 aligned with opposite side vertical holes that receive the threaded bar 56 therethrough. Upper and lower tension springs 64 and 66, respectively, tend to support the tube 42 in isolation as positioning can be effected by the upper and lower lock nut combinations 68 and 70. The opposite end tension assembly 46 is similarly constructed.

In operation, the check responsive control unit 12 is suitably mounted adjacent a passageway that it is desired to make secure. The guide rail 34 is then installed adjacent the control unit 12 generally beneath the positioning of pinion gear 38 to insure proper meshing of the rack 40 and pinion 38 combination. The gate 10 would then be positioned with trolley wheels 30 and 32 engaging guide rail 34 and pinion gear 38 positioned beneath rack gear 40, and some form of upper guide (not shown) or aligning device would be employed to maintain the vertical attitude of sliding gate 10.

The respective tension assemblies 44 and 46 would then be adjusted so that rack 40 would be in secure contact with pinion gear 38 during the entire traverse of gate 10. That is, despite any unevenness in the base or guide rail 34, the sliding gate 10 will receive positive drive at all times. Adjustment of tension assemblies 44 and 46 (see FIG. 4) is effected by complementary settings of upper and lower lock nut combinations 68 and 70 (FIG. 4) thereby to align the level of rack tube 42 while maintaining proper upper and lower tension at both ends. The gate 10 and control unit 12 would then be operational for control by a suitable check responsive actuating mechanism. Such checks may take the form of plastic card and card reader combinations, number combination punch control units, or simply a remote switch actuation under control of an attendant.

A suitable form of control device 12 is commercially available from The Stanley Works of Novi, Mich. as well as others. The operational limits of bidirectional gate movement may be set by positioning of limit switches relative to movement in the gear reducer mechanism (not shown) within the control device 12. Thus, open and closed gate stop conditions are readily adjusted into the system upon installation.

The foregoing discloses a novel gate control structure that may be utilized for improved gate control as it provides a readily installable and very reliable gate opening and closing mechanism. The rack bar adjustable tension assemblies are able to account for any discrepancies in right of way level, and the entire assembly represents a marked improvement as it replaces prior chain drive gate control systems.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A device for automatic control of a security gate, comprising:

a gate having vertical and horizontal bar members and plural wheels affixed on the bottom thereof aligned for linear gate movement to enable opening and closing of said gate;

a control unit actuatable to provide rotary output to a pinion gear disposed adjacent said gate;

first and second spring mounts disposed at opposite ends of said gate; and an elongated tube having a rack secured along a middle portion thereof, said tube being resiliently mounted between said first, and second spring mounts with the rack aligned in positive engagement with the pinion gear;

whereby the control unit may be selectively actuated to open and close said gate.

2. A device as set forth in claim 1 wherein each of said first and second spring mounts comprises:

upper and lower right angle brackets secured in spaced relationship on a selected vertical bar member;

a threaded retaining bar fastened between said upper and lower right angle brackets with said retaining bar disposed through said elongated tube;

first and second springs disposed on said retaining bar above and below said elongated tube; and first and second lock nuts threadedly engaged on said retaining bar above and below the respective first and second springs;

whereby the respective lock nuts can be adjusted to regulate the height and angle of said elongated tube and rack relative to the pinion gear.

3. A device as set forth in claim 2 wherein said elongated tube having a rack comprises:

a square tubing of selected length having vertical holes through opposite ends for receiving passage of said threaded retaining bars; and an elongated rack bar secured along said square tubing for engagement with said pinion gear.

4. A device as set forth in claim 2 which is further characterized to include:

a rail disposed below said gate for guiding contact with said gate plural wheels.

5. A device as set forth in claim 1 which is further characterized to include:

a rail disposed below said gate for guiding contact with said gate plural wheels.

* * * * *